US012427364B1

(12) United States Patent
Shi

(10) Patent No.: US 12,427,364 B1
(45) Date of Patent: Sep. 30, 2025

(54) DEVICE FOR ADJUSTING POSITIONS OF ARMREST BARS ON PILATES BEDS

(71) Applicant: Lingmin Shi, Zhejiang (CN)

(72) Inventor: Lingmin Shi, Zhejiang (CN)

( * ) Notice: Subject to any disclaimer, the term of this patent is extended or adjusted under 35 U.S.C. 154(b) by 0 days.

(21) Appl. No.: 19/230,815

(22) Filed: Jun. 6, 2025

(51) Int. Cl.
*A63B 21/00* (2006.01)

(52) U.S. Cl.
CPC .... *A63B 21/4031* (2015.10); *A63B 21/00069* (2013.01); *A63B 2225/093* (2013.01)

(58) Field of Classification Search
CPC ..... A63B 21/4031; A63B 21/00069; A63B 2225/093; A63B 22/0076; A63B 22/87
See application file for complete search history.

(56) References Cited

U.S. PATENT DOCUMENTS

| | | | | |
|---|---|---|---|---|
| 6,220,995 | B1 * | 4/2001 | Chen | A63B 21/02 601/24 |
| 6,966,871 | B2 * | 11/2005 | Parmater | A63B 21/023 482/130 |
| 7,803,095 | B1 * | 9/2010 | LaGree | A63B 22/0089 482/121 |
| 9,597,545 | B1 * | 3/2017 | Lagree | A63B 22/0046 |
| 10,843,031 | B1 * | 11/2020 | Anne | A63B 22/0087 |
| 2019/0255377 | A1 * | 8/2019 | Aronson | A63B 22/0089 |
| 2020/0222741 | A1 * | 7/2020 | Aronson | A63B 21/4034 |

* cited by examiner

*Primary Examiner* — Andrew S Lo
(74) *Attorney, Agent, or Firm* — Justin Lampel

(57) ABSTRACT

An adjusting device for a Pilates bed armrest bar is provided. The device includes an armrest bar, adjusting members and clamping members, wherein armrest bar has rotatable rods. A cross bar is connected between rotatable rods of the device. As a user pulls upward on the rotatable rods of the adjusting device of the Pilates armrest bar to adjust the Pilates bed armrest to a corresponding desired resistance.

6 Claims, 6 Drawing Sheets

DEVICE FOR ADJUSTING POSITIONS OF ARMREST BARS ON PILATES BEDS

TECHNICAL FIELD

The invention belongs to the field of Pilates beds, and in particular relates to a device for adjusting positions of armrest bars on Pilates beds.

BACKGROUND

In the field of modern fitness, Pilates has been widely welcomed as a form of exercise that emphasizes core muscle training and improves body flexibility and balance. Pilates beds are one of the important equipment in Pilates exercise, and the design and function thereof play a key role in the user's exercise experience and effect.

At present, there are some problems in the gear setting of handrails of the common Pilates beds on the market. Some Pilates beds are designed to adjust the gear with one-handed operation. The original intention is to facilitate users to adjust according to their own feelings at any time during exercise. However, in actual use, this design is prone to misoperation, because during exercise, a user's body is in a dynamic state, and the stability and accuracy of one-handed operation are difficult to guarantee. Once the operation is wrong, the gear of the handrail may change suddenly, causing the user who is exercising to lose balance, causing accidental injuries, and seriously affecting the user's safety and use experience. In summary, the handrail gear setting method of the existing Pilates bed needs to be improved to improve the users' convenience and safety.

Therefore, a device for adjusting the handrail position on the Pilates bed is needed to solve the above problems.

SUMMARY

The purpose of embodiments of the present invention is to provide a device for adjusting positions of armrest bars on Pilates beds to solve problems raised in the above background technology.

To achieve the above purpose, the present invention provides following technical solutions:

A device for adjusting positions of armrest bars on Pilates beds, comprises an armrest bar, fixing members, a Pilates bed main body, adjusting members and clamping members, wherein the armrest bar comprises rotatable rods, a cross bar is connected between the rotatable rods, through grooves are penetrated through sides of the rotatable rods, first limiting rods and second limiting rods are connected inside the rotatable rods, inside the rotatable rods are penetrated pin rods, the pin rods are in respective threaded connection to both sides of the main body of the Pilates bed main body, and bottom portions of the rotatable rods are in threaded connection to threaded rods;

the fixing members comprise fixing plates, clamping holes are provided in the fixing plates, and the fixing plates are connected to two sides of the Pilates bed main body by bolts;

the adjusting members comprise movable frames, thread sleeves are inserted into the movable frames, operating rod are in internally threaded connection to the thread sleeves, operating rods are slidably connected to through grooves in middle portions, adjusting holes are formed on back portions of the movable frames, springs are connected to bottom end portions of the movable frames, and bottom end portions of the springs are connected to the threaded rods; and the clamping members comprise push rods, the push rods are slidably connected in the adjusting holes, clamping rods are clamped outside the push rods, the clamping rods are inserted into the clamping holes, and the clamping rods are slidably connected in the rotatable rods.

By setting up the above structure and simultaneously pressing the operating rods to adjust the resistance level of the Pilates bed, different exercise effects can be achieved.

As a further technical solution, front and back sides of the movable frames are provided with first limiting holes and second limiting holes.

As a further technical solution, sliding holes are formed on sides of the movable frames away from each other, and the clamping rods are arranged in the sliding holes.

As a further technical solution, the clamping holes are distributed in circular arrays around the pin rods.

As a further technical solution, the first limiting rods are slidably connected inside the first limiting holes, and the second limiting rods are slidably connected inside the second limiting holes.

As a further technical solution, shapes of the adjusting holes are set to be arcs.

Compared with the prior art, the beneficial effects of the present invention are as follows:

In the present invention, both hands pull the operating rods upward at the same time, and the moving operating rods drive the movable frames to move through the threaded sleeves, and the moving movable frames drive the adjusting holes to move upward, and the two adjusting holes moving upward are separated from each other through the push rods, and the clamping rods that are separated from each other are moved out of the clamping holes, and then the rotatable rods are pushed by the operating rods to rotate around the pin rods. When the rotatable rods move to the appropriate gear, the operating rods are slowly released, and the clamping rods close to each other move into the corresponding clamping holes. At this time, the armrest bar can be adjusted to the corresponding resistance gear, so that a user can easily adjust the various resistance gears of the Pilates bed according to different needs, and the operation is convenient.

In the present invention, since the device needs to be pressed by both hands at the same time to adjust the gear, the resistance gear of the device is not easy to be adjusted due to accidental touch, which increases the safety of the device.

In the present invention, since the movable frames, the adjusting holes, the push rods and the clamping rods are all arranged in the movable frames, the adjustment structure of the device is set to be hidden, making the device more beautiful.

In order to more clearly explain structural features and functions of the present invention, the present invention is described in detail in combination with the accompanying drawings and specific embodiments.

DESCRIPTION OF REFERENCE NUMERALS

1. armrest bar; 11. rotatable rod; 12. cross bar; 13. through groove; 14. first limiting rod; 15. second limiting rod; 16. pin rod; 17. threaded rod; 2. fixing member; 21. fixing plate; 22. clamping hole; 3. Pilates bed main body; 4. adjusting member; 41. movable frame; 42. thread sleeve; 43. operating rod; 44. first limiting hole; 45. second limiting hole; 46. adjusting hole; 47. sliding hole; 48. spring; 5. clamping member; 51. push rod; and 52. clamping rod.

DETAILED DESCRIPTION OF THE EMBODIMENTS

In order to make the purpose, technical solutions and advantages of the present invention more clear, the present invention is further described in detail below in conjunction with the accompanying drawings and embodiments. It should be understood that the specific embodiments described herein are only used to explain the present invention and are not used to limit the present invention.

The specific implementation of the present invention is described in detail below in conjunction with specific embodiments.

Figure 1:
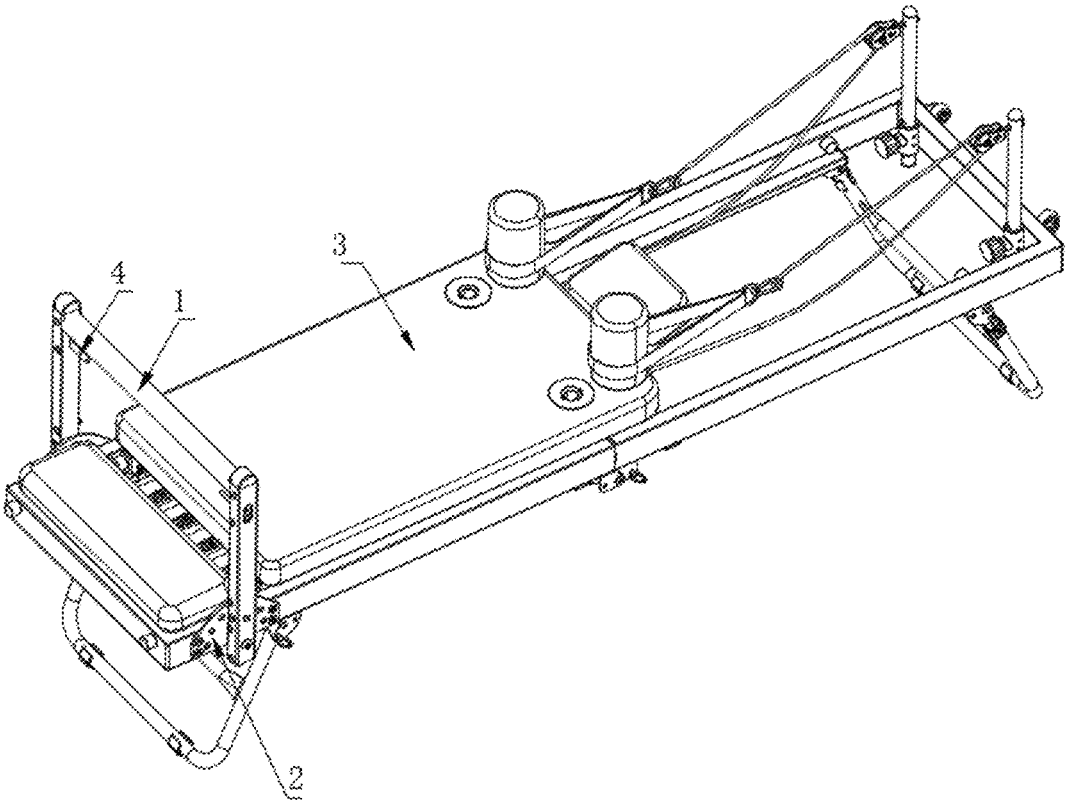
FIG. 1 is a structural schematic diagram of a front view of the present invention.
Figure 2:
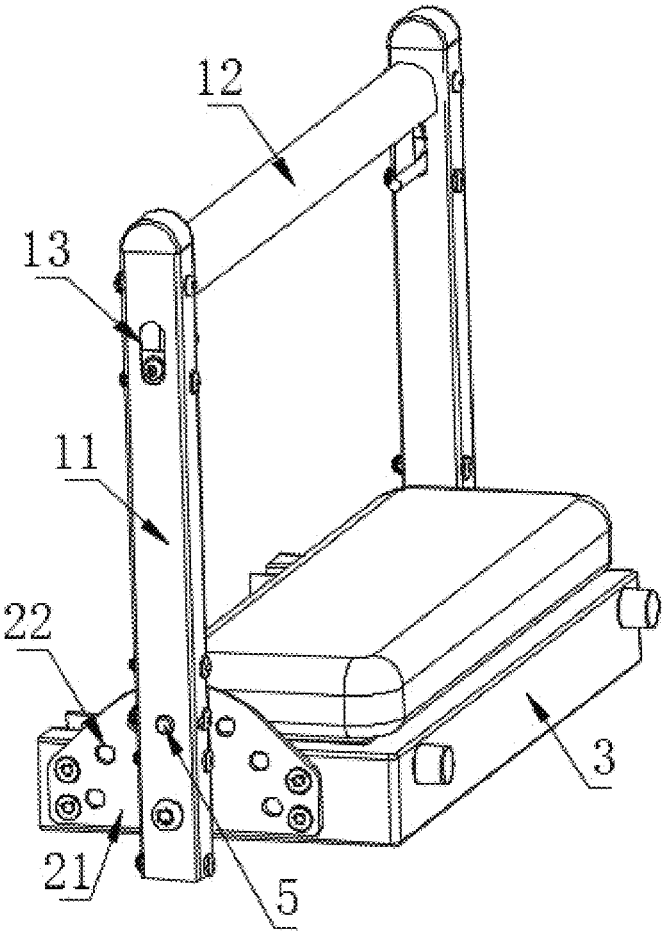
FIG. 2 is a structural schematic diagram of a partial side view of the present invention.
Figure 3:
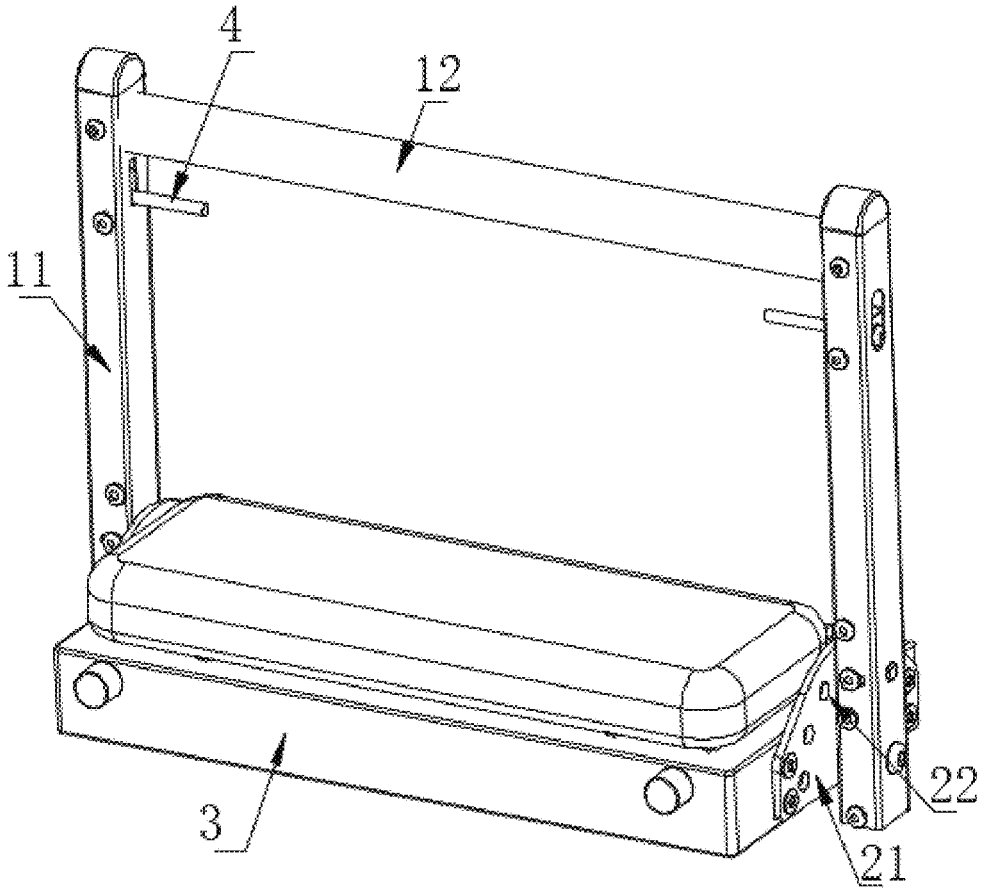
FIG. 3 is a structural schematic diagram of a partial front view of the present invention.
Figure 4:
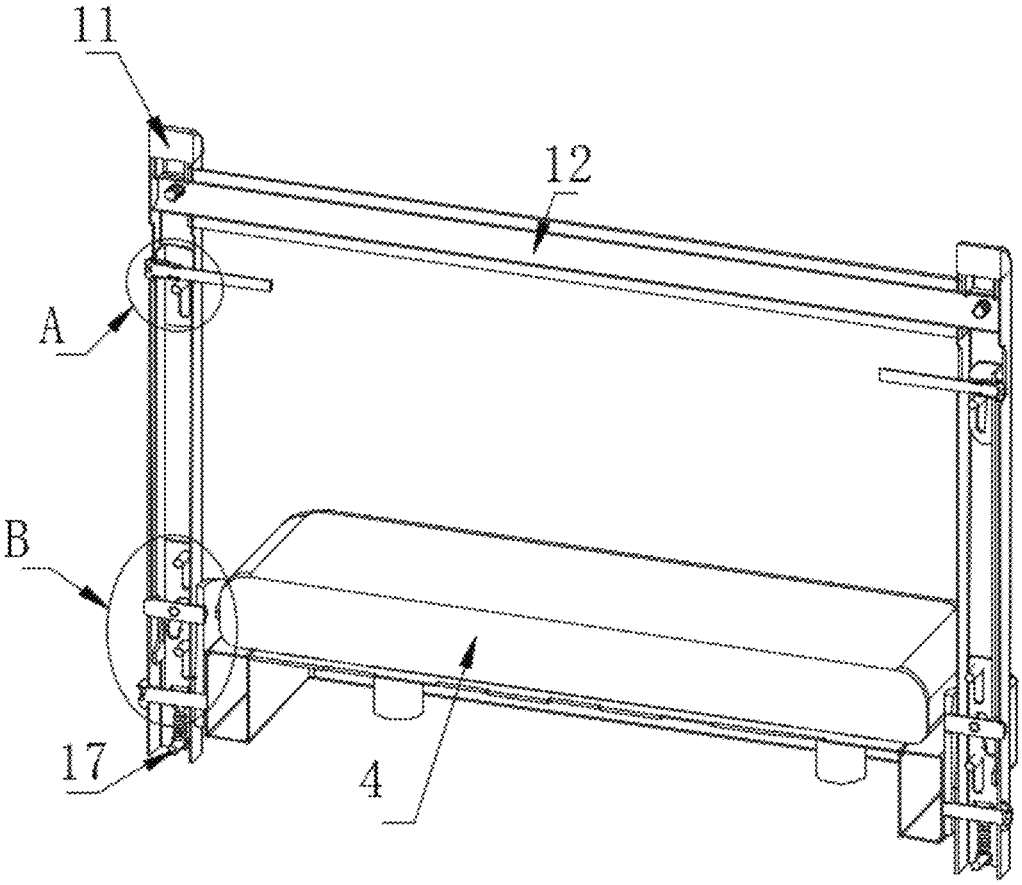
FIG. 4 is a schematic diagram of a cross-sectional structure of the partial front view of the present invention.
Figure 5:
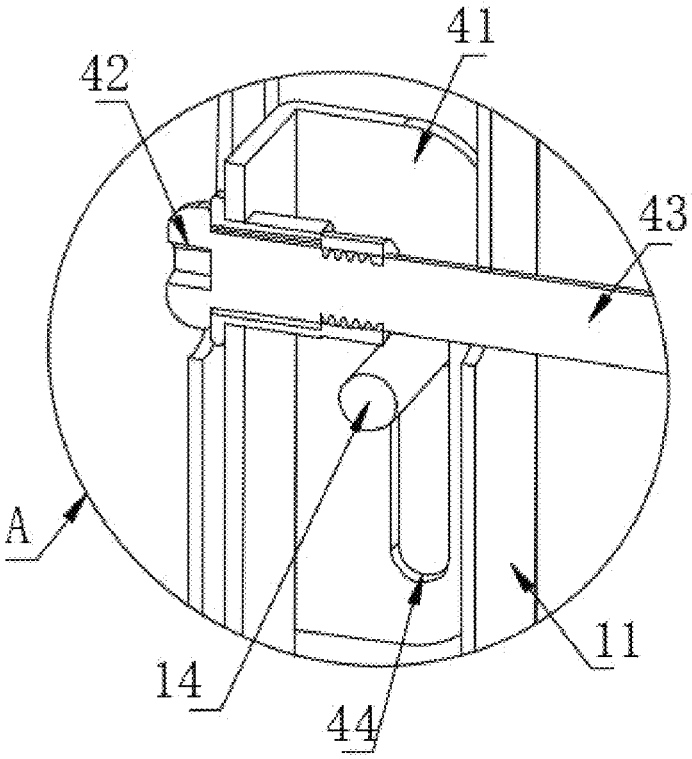
FIG. 5 is an enlarged schematic diagram showing structure at part "A" in FIG. 4 of the present invention.
Figure 6:
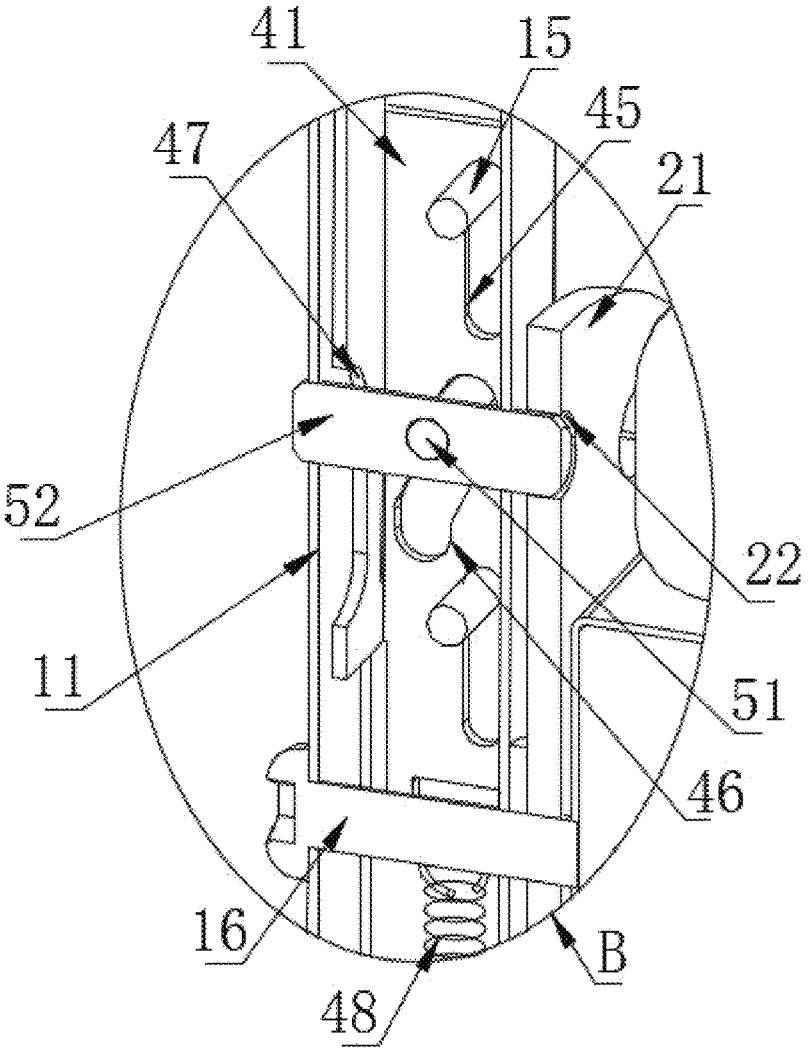
FIG. 6 is an enlarged schematic diagram showing structure at part "B" in FIG. 4 of the present invention.

Embodiment 1: As shown in FIGS. 1-6, an embodiment of the preset invention provides a device for adjusting positions of armrest bars on Pilates beds, comprises an armrest bar 1, fixing members 2, a Pilates bed main body 3, adjusting members 4 and clamping members 5, wherein the armrest bar 1 comprises rotatable rods 11, a cross bar 12 is connected between the rotatable rods 11, through grooves 13 are penetrated through sides of the rotatable rods 11, first limiting rods 14 and second limiting rods 15 are connected inside the rotatable rods 11, inside the rotatable rods 11 are penetrated pin rods 16, the pin rods 16 are in respective threaded connection to both sides of the main body 3 of the Pilates bed main body 3, and bottom portions of the rotatable rods 11 are in threaded connection to threaded rods 17;

the fixing members 2 comprise fixing plates 21, clamping holes 22 are provided in the fixing plates 21, and the fixing plates 21 are connected to two sides of the Pilates bed main body 3 by bolts;

the adjusting members 4 comprise movable frames 41, thread sleeves 42 are inserted into the movable frames 41, operating rod 43 are in internally threaded connection to the thread sleeves 42, operating rods 43 are slidably connected to through grooves 13 in middle portions, adjusting holes 46 are formed on back portions of the movable frames 41, springs 48 are connected to bottom end portions of the movable frames 41, and bottom end portions of the springs 48 are connected to the threaded rods 17; and the clamping members 5 comprise push rods 51, the push rods 51 are slidably connected in the adjusting holes 46, clamping rods 52 are clamped outside the push rods 51, the clamping rods 52 are inserted into the clamping holes 22, and the clamping rods 52 are slidably connected in the rotatable rods 11.

In the present embodiment, when a resistance gear of the armrest bar 1 needs to be adjusted, both hands pull the operating rods 43 upward at the same time, moving operating rods 43 drive the movable frames 41 to move through the thread sleeves 42. The moving movable frames 41 drive the first limiting holes 44, the second limiting holes 45, the adjusting holes 46 and the sliding holes 47 to move. Moving the first limiting holes 44 slide outside the first limiting rods 14, moving second limiting holes 45 slide outside the second limiting rods 15, upwardly moving sliding holes 47 slide outside the clamping holes 22, upwardly moving adjusting holes 46 drive the push rods 51 to move away from each other, the push rods 51 moving away from each other both slide outside the rotatable rods 11, and the clamping rods 52 moving away from each other both move away from each other, the movable frames 41 move out of the clamping holes 22, and then the operating rods 43 push the rotatable rods 11 to rotate around the pin rods 16, and at the same time, the movable frames 41 moving upwards both stretch the springs 48. When the rotatable rods 11 move to appropriate gear positions, the moving rotatable rods 11 both drive the clamping rods 52 and the corresponding clamping holes 22, and then slowly release the operating rods 43, the movable frames 41 move downward under elastic forces of the springs 48, and the movable frames 41 moving downward drive the adjusting holes 46 to move downward. The two adjusting holes 46 moving downward both drive the clamping rods 52 to approach each other through the push rods 51, and the clamping rods 52 approaching each other move into the corresponding clamping holes 22. At this time, the armrest bar 1 can be adjusted to the corresponding resistance gear position.

Specifically, front and back sides of the movable frames 41 are provided with first limiting holes 44 and second limiting holes 45, the first limiting rods 14 are slidably connected inside the first limiting holes 44, and the second limiting rods 15 are slidably connected inside the second limiting holes 45.

In the present embodiment, the first limiting rods 14 can limit moving movable frames 41 through the first limiting holes 44, and the second limiting rods 15 can lower the moving movable frames 41 through the second limiting holes 45, so that the moving movable frames 41 will not shake during movement, so that the moving movable frames 41 can move smoothly.

Specifically, sliding holes 47 are formed on sides of the movable frames 41 away from each other, and the clamping rods 52 are arranged in the sliding holes 47.

In the present embodiment, since the clamping rods 52 are slidably connected in the sliding holes 47, the clamping rods 52 can limit the movable frames 41 moving through the sliding holes 47.

Specifically, the clamping holes 22 are distributed in circular arrays around the pin rods 16.

In the present embodiment, the rotating rotatable rods 11 can rotate around the pin rods 16 to drive the clamping rods 52 to move to positions aligned with the clamping holes 22 in sequence and accurately.

Specifically, shapes of the adjusting holes 46 are set to be arcs.

In the present embodiment, when the movable frames 41 drive the adjusting holes 46 to move, since the adjusting holes 46 are configured in arc shapes, the arc-shaped adjusting holes 46 can drive the push rods 51 to slide in the rotatable rods 11.

The above are merely preferred embodiments of the present invention and are not intended to limit the present invention. Any modifications, equivalent replacements and improvements made within the spirit and principles of the present invention should all be included within the protection scope of the present invention.

What is claimed is:

1. A device for adjusting positions of armrest bars on Pilates beds, comprising an armrest bar (1), fixing members (2), a Pilates bed main body (3), adjusting members (4) and clamping members (5), wherein the armrest bar (1) comprises rotatable rods (11), a cross bar (12) is connected between the rotatable rods, through grooves (13) penetrating through sides of the rotatable rods, first limiting rods (14) and second limiting rods (15) are connected inside the rotatable rods (11), inside the rotatable rods (11) are pin rods (16), the pin rods (16) are in respective threaded connection to both sides of the Pilates bed main body (3), and bottom portions of the rotatable rods (11) are in threaded connection to threaded rods (17);

the fixing members (2) comprise fixing plates (21), clamping holes (22) are provided in the fixing plates (21), and the fixing plates (21) are connected to two sides of the Pilates bed main body (3) by bolts;

the adjusting members (4) comprise movable frames (41), thread sleeves (42) are inserted into the movable frames (41), and operating rods (43) are in internally threaded connection to the thread sleeves (42), the operating rods (43) are slidably connected to the through grooves (13) in middle portions, adjusting holes (46) are formed on back portions of the movable frames (41), springs (48) are connected to bottom end portions of the movable frames (41), and bottom end portions of the springs (48) are connected to the threaded rods (17); and the clamping members (5) comprise push rods (51), the push rods (51) are slidably connected in the adjusting holes (46), clamping rods (52) are clamped outside the push rods (51), the clamping rods (52) are inserted into the clamping holes (22), and the clamping rods (52) are slidably connected in the rotatable rods (11).

2. The device for adjusting positions of armrest bars on Pilates beds according to claim 1, wherein front and back sides of the movable frames (41) are provided with first limiting holes (44) and second limiting holes (45).

3. The device for adjusting positions of armrest bars on Pilates beds according to claim 1, wherein sliding holes (47) are formed on sides of the movable frames (41) away from each other, and the clamping rods (52) are arranged in the sliding holes (47).

4. The device for adjusting positions of armrest bars on Pilates beds according to claim 1, wherein the clamping holes (22) are distributed in circular arrays around the pin rods (16).

5. The device for adjusting positions of armrest bars on Pilates beds according to claim 2, wherein the first limiting rods (14) are slidably connected inside the first limiting holes (44) and the second limiting rods (15) are slidably connected inside the second limiting holes (45).

6. The device for adjusting positions of armrest bars on Pilates beds according to claim 1, wherein shapes of the adjusting holes (46) are set to be arcs.

* * * * *